US007155831B2

(12) United States Patent
Huang et al.

(10) Patent No.: US 7,155,831 B2
(45) Date of Patent: Jan. 2, 2007

(54) CERAMIC CUTTING TOOL

(75) Inventors: Gwo-Yan Huang, Tu-Chen (TW); Yan-Li Xu, Shenzhen (CN); Chun He, Shenzhen (CN); Wu-Kuang Chen, Tu-Chen (TW); Chih-Chien Hung, Tu-chen (TW); Mu-Chi Hsu, Tu-chen (TW); Yi-Ta Chung, Tu-chen (TW)

(73) Assignees: Hong Fu Jin Precision Ind. (Shenzhen) Co., Ltd., Shenzhen (CN); Hon Hai Precision Ind. Co., Ltd., Tu-Cheng (TW)

( * ) Notice: Subject to any disclaimer, the term of this patent is extended or adjusted under 35 U.S.C. 154(b) by 21 days.

(21) Appl. No.: 10/889,828

(22) Filed: Jul. 12, 2004

(65) Prior Publication Data

US 2005/0022646 A1 Feb. 3, 2005

(30) Foreign Application Priority Data

Jul. 11, 2003 (TW) ..... 92212813 U

(51) Int. Cl.
*B26B 9/02* (2006.01)

(52) U.S. Cl. ..... 30/225; 30/357

(58) Field of Classification Search ..... 30/225, 30/254, 348, 346.53, 357, 350; 76/107.8
See application file for complete search history.

(56) References Cited

U.S. PATENT DOCUMENTS 358,234 A * 2/1887 Vache ..... 30/339
693,524 A * 2/1902 Korn ..... 30/32
D43,817 S * 4/1913 Gaisman ..... D28/47
1,600,922 A * 9/1926 Berger ..... 30/57
1,837,523 A * 12/1931 Braden ..... 72/340
4,709,480 A * 12/1987 Takigawa et al. ..... 30/254
5,382,273 A 1/1995 Mehrotra et al.
5,525,134 A 6/1996 Mehrotra et al.
6,378,215 B1 * 4/2002 Carman ..... 30/192
2005/0126016 A1 * 6/2005 Branden ..... 30/346.54

* cited by examiner

*Primary Examiner*—Hwei-Siu Payer
(74) *Attorney, Agent, or Firm*—Wei Te Chung

(57) ABSTRACT

A ceramic cutting tool (100) is for high speed cutting of light, thin and soft materials. The ceramic cutting tool includes an upper blade (10) and a lower blade (20) both made of ceramic material. The upper and lower blades therefore possess extremely high hardness, and excellent wear resistance and heat resistance. This increases an operating lifetime of the ceramic cutting tool. Furthermore, the lower blade can alternatively be a lower blade assembly (30). The lower blade assembly includes a metal base (32), and a ceramic edge insert (31) detachably mounted in the metal base. If the ceramic edge insert becomes worn or is damaged, it can be easily replaced by a new ceramic edge insert. There is no need to replace the metal base.

5 Claims, 3 Drawing Sheets

CERAMIC CUTTING TOOL

BACKGROUND OF THE INVENTION

1. Field of the Invention

The invention relates generally to cutting tools; and more particularly to a cutting tool made of ceramic material.

2. Description of Related Art

Conventional cutting tools are generally made of metallic materials. These cutting tools are used for machining hard metallic materials such as cast iron, steel, and the like. When a typical cutting tool performs repeated cutting, the temperature of the cutting tool increases, and this results in reduced hardness of the cutting tool. The cutting tool generally has poor heat resistance and poor resistance to wear, and is liable to become blunt over time. This reduces the cutting tool's effectiveness, and leads to inconsistent and unwanted cutting results.

In order to circumvent the above-mentioned disadvantages, ceramic materials have been used to make cutting tools. Ceramics possess extremely high hardness, and excellent wear resistance and heat resistance. U.S. Pat. Nos. 5,382,273 and 5,525,134 respectively disclose ceramic cutting tools. Each ceramic cutting tool comprises a rake face, a flank face, and a cutting edge defined at a junction of the rake face and the flank face. The ceramic cutting tool is used for cutting metallic materials.

However, conventional ceramic cutting tools comprise only one blade. These cutting tools can cut light, thin and soft materials only at relatively low speeds. Furthermore, once the cutting edge of the blade becomes worn or is damaged, the entire cutting tool must be replaced. Moreover, ceramic materials are brittle, and the cutting tools made thereof are apt to be damaged.

A new ceramic cutting tool which overcomes the above-mentioned problems is desired.

BRIEF SUMMARY OF THE INVENTION

Accordingly, an object of the present invention is to provide a ceramic cutting tool able to cut light, thin and soft materials at high speeds.

Another object of the present invention is to provide a ceramic cutting tool with a detachable ceramic edge insert.

To achieve the first of the above-mentioned objects, the present invention provides a ceramic cutting tool comprising an upper blade and a lower blade. The upper blade and lower blade are both made of ceramic material.

To achieve the second of the above-mentioned objects, the present invention provides a ceramic cutting tool comprising an upper blade and a lower blade assembly. The lower blade assembly comprises a metal base, and a ceramic edge insert detachably mounted in the metal base.

The ceramic cutting tool corresponding to the first object has the following advantages. Because the upper and lower blades are both made of ceramic materials, they possess extremely high hardness, and excellent wear resistance and heat resistance. This increases an operating lifetime of the ceramic cutting tool. Thus, the ceramic cutting tool is well suited to automated machining of light, thin and soft materials at high speeds.

The ceramic cutting tool corresponding to the second object has advantages similar to those described above in relation to the ceramic cutting tool corresponding to the first object. Furthermore, if the ceramic edge insert becomes worn or is damaged, it can be easily replaced by a new ceramic edge insert. There is no need to replace the metal base.

Other objects, advantages and novel features of the invention will become more apparent from the following detailed description when taken in conjunction with the accompanying drawings, in which:

DESCRIPTION OF THE PREFERRED EMBODIMENTS

Figure 1:
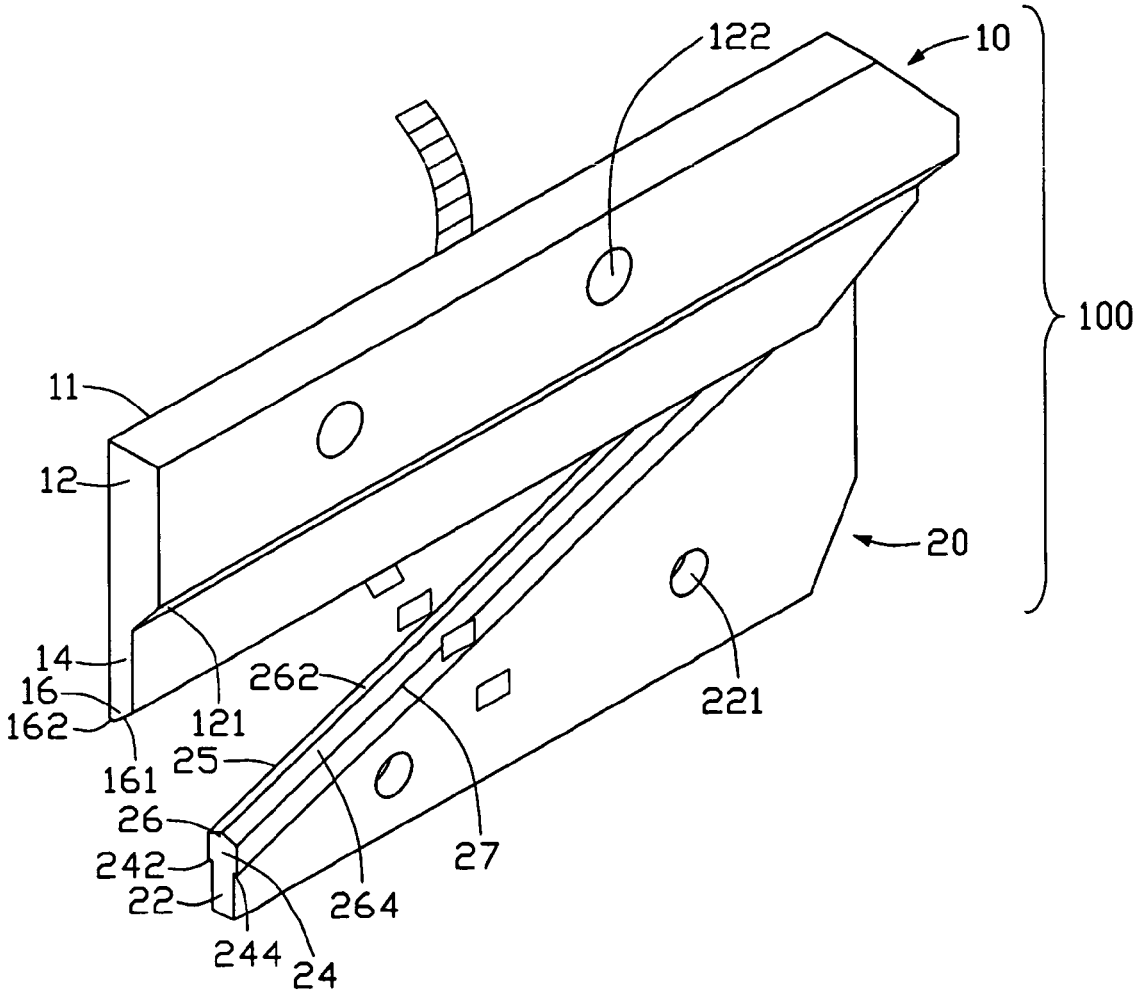
FIG. 1 is an isometric view of a ceramic cutting tool in accordance with a first embodiment of the present invention, showing the ceramic cutting tool machining a strip of material.

Referring to FIG. 1, a ceramic cutting tool 100 in accordance with a first embodiment of the present invention is shown. The ceramic cutting tool 100 comprises an upper blade 10 and a lower blade 20. The upper blade 10 comprises a body 12, an upper edge portion 16, and a transition portion 14 interconnecting the body 12 and the upper edge portion 16. The transition portion 14 is thinner than the body 12, and the upper edge portion 16 is beveled. The body 12, the transition portion 14 and the upper edge portion 16 share a common plane inner surface 11. An upper inclined surface 121 is defined at a junction of the body 12 and the transition portion 14 opposite from the inner surface 11. The upper edge portion 16 has a slanted surface 161. A junction of the slanted surface 161 and the inner surface 11 defines an edge 162. A plurality of upper assembly holes 122 is defined in the body 12. The upper blade 10 is fixed on an upper arm (not shown) of a cutting device (not shown) via the upper assembly holes 122.

The lower blade 20 comprises a supporting portion 22, a lower edge portion 26, and a connecting portion 24 interconnecting the supporting portion 22 and the lower edge portion 26. The supporting portion 22 is generally trapezoidal, so that the connecting portion 24 and the lower edge portion 26 can form an oblique cutting angle relative to the edge 162 of the upper blade 10. The connecting portion 24 is thicker than the supporting portion 22. Thus a pair of opposite steps 242, 244 is formed at a junction of the supporting portion 22 and the connecting portion 24. The lower edge portion 26 has a pair of symmetrically opposite slanted surfaces 262, 264 that meet at a central apex edge (not labeled). Junctions of the slanted surfaces 262, 264 and the connecting portion 24 respectively define a pair of edges 25, 27. Both the edges 25, 27 can be used for cutting operations, which increases an operating lifetime of the lower blade 20. Furthermore, pieces of material cut by the ceramic cutting tool 100 can drop down over either of the slanted surfaces 262, 264. This makes collection of the pieces of materials convenient. A plurality of lower assembly holes 221 is defined in the supporting portion 22. The lower blade 20 is fixed on a lower arm (not shown) of the cutting device via the lower assembly holes 221.

The upper and lower blades 10, 20 are both made of ceramic material. The upper and lower blades 10, 20 therefore possess extremely high hardness, and excellent wear resistance and heat resistance. This increases an operating lifetime of the ceramic cutting tool 100. Thus, the ceramic cutting tool 100 is well suited to automated machining of light, thin and soft materials at high speeds.

Figure 2:
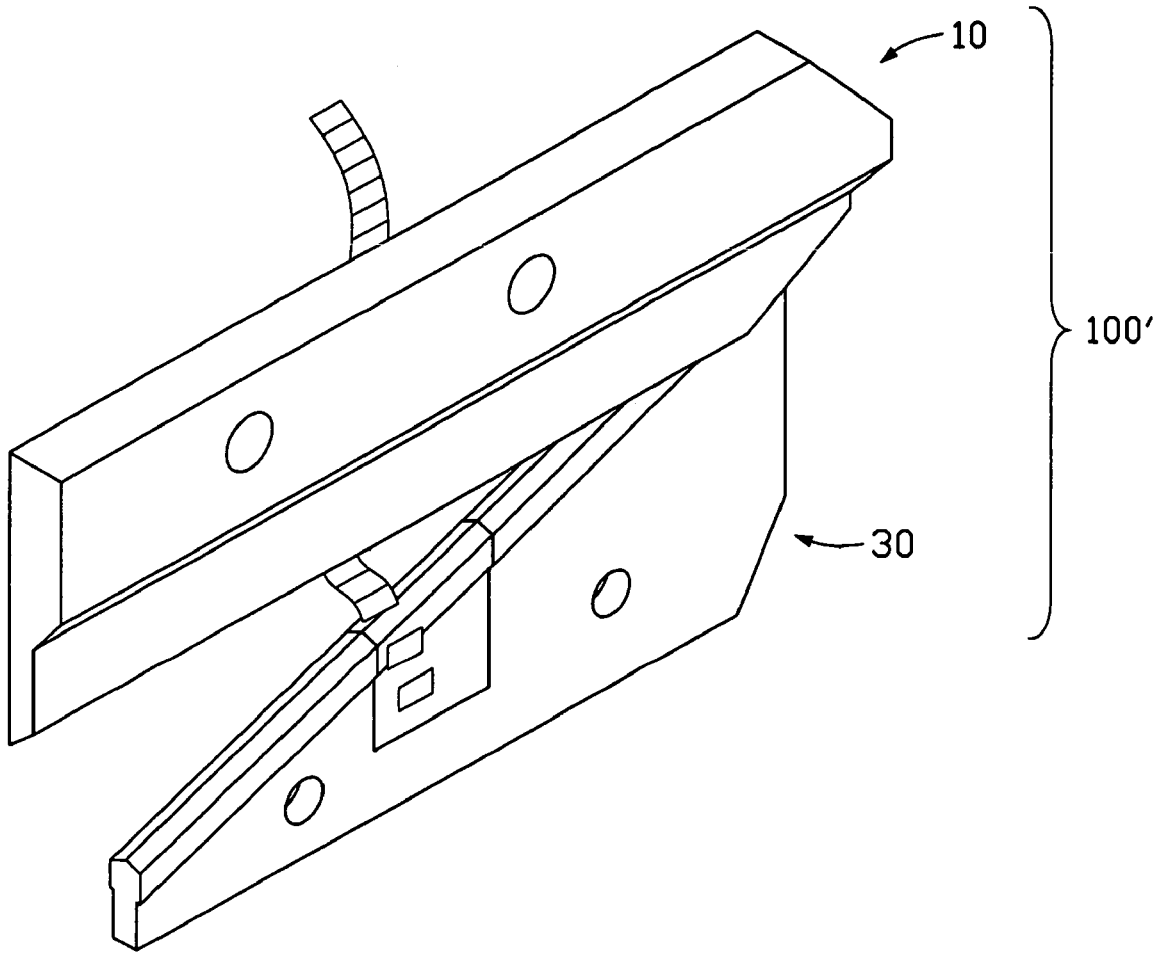
FIG. 2 is an isometric view of the ceramic cutting tool in accordance with a second embodiment of the present invention, showing the ceramic cutting tool machining a strip of material.
Figure 3:
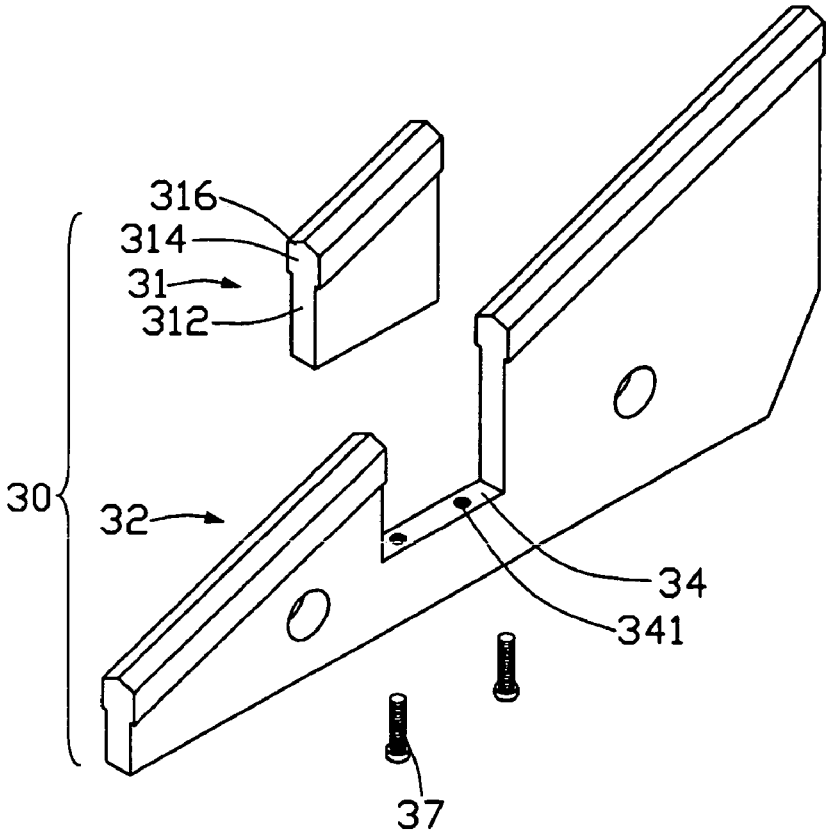
FIG. 3 is an exploded view of a lower blade assembly of the ceramic cutting tool of FIG. 2.

Referring to FIG. 2, a ceramic cutting tool 100' in accordance with a second embodiment of the present invention is shown. The ceramic cutting tool 100' is similar to the ceramic cutting tool 100 of the first embodiment, except that a lower blade assembly 30 is adopted instead of the lower blade 20. The lower blade assembly 30 is shown in FIG. 3, and comprises a metal base 32 and a ceramic edge insert 31.

The ceramic edge insert 31 is similar in structure to the lower blade 20 of the ceramic cutting tool 100. However, the ceramic edge insert 31 is smaller than the lower blade 20, and a pair of screw thread holes (not visible) is defined in a bottom (not labeled) of the ceramic edge insert 31. The ceramic edge insert 31 comprises a supporting portion 312, a lower edge portion 316, and a connecting portion 314 interconnecting the supporting portion 312 and the lower edge portion 316. A pair of opposite steps (not labeled) is formed at a junction of the supporting portion 312 and the connecting portion 314. The lower edge portion 316 comprises a pair of symmetrically opposite slanted surfaces (not labeled).

The metal base 32 is used for holding and supporting the ceramic edge insert 31. The metal base 32 is similar to the lower blade 20 of the ceramic cutting tool 100, except that a gap (not labeled) is defined therein. The gap is sized to fittingly receive the ceramic edge insert 31. A pair of mounting holes 341 is defined in a supporting surface 34 of the metal base 32 beneath the gap, corresponding to the screw thread holes of the ceramic edge insert 31. The mounting holes 341 run through the metal base 32. A pair of bolts 37 is inserted through the mounting holes 341 of the metal base 32 and engaged in the screw thread holes of the ceramic edge insert 31, thereby fixing the ceramic edge insert 31 on the metal base 32.

Figure 4:
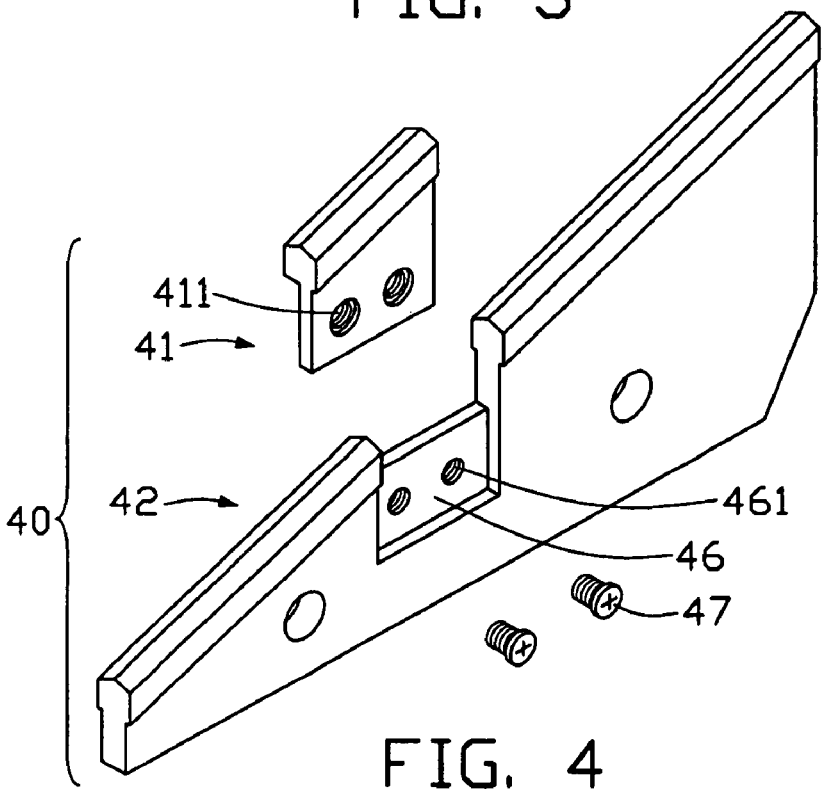
FIG. 4 is an exploded, isometric view of an alternative lower blade assembly for the ceramic cutting tool of FIG. 2.

Referring to FIG. 4, an alternative lower blade assembly 40 is shown. The lower blade assembly 40 comprises a metal base 42 and a ceramic edge insert 41. A pair of mounting holes 411 is defined in a supporting portion of the ceramic edge insert 41. A gap (not labeled) is defined in the metal base 42. A mounting board 46 is provided in the gap, the mounting board 46 being integrally formed with the metal base 42. A pair of screw thread holes 461 is defined in the mounting board 46, corresponding to the mounting holes 411 of the ceramic edge insert 41. The screw thread holes 461 run through the mounting board 46. A pair of bolts 47 is inserted through the mounting holes 411 of the ceramic edge insert 41 and engaged in the screw thread holes 461 of the mounting board 46, thereby fixing the ceramic edge insert 41 on the metal base 42.

The ceramic cutting tool 100' has advantages similar to those described above in relation to the ceramic cutting tool 100. Furthermore, if the ceramic edge insert 31, 41 becomes worn or is damaged, it can be easily replaced by a new ceramic edge insert 31, 41. There is no need to replace the metal base 32, 42.

In a further alternative lower blade assembly, a ceramic lower edge portion with a connecting portion may be detachably mounted to a metal base, in much the same way that the ceramic edge insert 31, 41 is detachably mounted to the metal base 32, 42.

In another embodiment of the ceramic cutting tool of the present invention, an upper blade assembly can be adopted instead of the upper blade 10. Such upper blade assembly can comprise a ceramic edge insert detachably mounted in a metal base, in similar fashion to the above-described lower blade assemblies 30 or 40. In a further embodiment, a ceramic cutting tool can adopt both an upper blade assembly and a lower blade assembly. The upper and lower blade assemblies can each comprise a ceramic edge insert detachably mounted in a metal base.

It is understood that the above-described embodiments are intended to illustrate rather than limit the invention. Variations may be made to the embodiments without departing from the spirit of the invention. Accordingly, it is appropriate that the appended claims be construed broadly and in a manner consistent with the scope of the invention.

What is claimed is:

1. A ceramic cutting tool comprising:

an upper blade; and a lower blade including a supporting portion, a lower edge portion and a connecting portion interconnecting the supporting portion and the lower edge portion, the lower edge portion having a pair of opposite slanted surfaces, and a pair of edges respectively defined by junctions of the slanted surfaces and the connecting portion, and a step formed at a junction of the supporting portion and the connecting portion;

wherein the upper and lower blades are both made of ceramic material.

2. The ceramic cutting tool as claimed in claim 1, wherein the upper blade comprises a body, an upper edge portion and a transition portion interconnecting the body and the upper edge portion.

3. The ceramic cutting tool as claimed in claim 2, wherein the body of the upper blade defines a plurality of upper assembly holes therein.

4. The ceramic cutting tool as claimed in claim 1, wherein the supporting portion of the lower blade defines a plurality of lower assembly holes therein.

5. The ceramic cutting tool as claimed in claim 1, wherein the supporting portion is substantially trapezoidal.

* * * * *